US007601014B2

(12) United States Patent
Wandler

(10) Patent No.: US 7,601,014 B2
(45) Date of Patent: Oct. 13, 2009

(54) HIGH-VOLTAGE RUBBER CONE PLUG-IN CONNECTOR

(75) Inventor: Bernd Wandler, Wedel / Holstein (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 352 days.

(21) Appl. No.: 11/568,272

(22) PCT Filed: Apr. 15, 2005

(86) PCT No.: PCT/IB2005/051239

§ 371 (c)(1),
(2), (4) Date: Oct. 25, 2006

(87) PCT Pub. No.: WO2005/107021

PCT Pub. Date: Nov. 10, 2005

(65) Prior Publication Data

US 2008/0242134 A1 Oct. 2, 2008

(30) Foreign Application Priority Data

Apr. 29, 2004 (EP) ..... 04101834

(51) Int. Cl.
*H01R 13/53* (2006.01)

(52) U.S. Cl. ..... 439/181

(58) Field of Classification Search ..... 439/320, 439/271, 201, 617, 258, 470, 181, 183–187, 439/99, 921; 378/101, 121
See application file for complete search history.

(56) References Cited

U.S. PATENT DOCUMENTS 3,871,736 A * 3/1975 Carter ..... 439/389
3,888,559 A * 6/1975 Geib ..... 439/258
4,296,986 A * 10/1981 Herrmann, Jr. ..... 439/322
4,335,928 A 6/1982 Barrett et al.
5,173,062 A 12/1992 Uchida et al.
5,358,419 A 10/1994 Pejsa et al.
6,213,805 B1 * 4/2001 Jedlitschka et al. ..... 439/271
6,556,654 B1 * 4/2003 Hansen et al. ..... 378/101
7,033,192 B2 * 4/2006 Hansen ..... 439/181

(Continued)

FOREIGN PATENT DOCUMENTS

DE 1092090 B 11/1960

(Continued)

*Primary Examiner*—Chandrika Prasad

(57) ABSTRACT

A high-voltage connector is described, having a plug (10) with a rubber cone (131; 132, 133) for insertion in a socket (20). A connector of this kind is also referred to as a rubber-cone plug system and is used in particular for connecting X-ray generators to high voltage generators. The connector is characterized in particular by the facts that the rubber cone has a first portion (131) having a first angle of application (A) in a tight-fitting joint (14) and at least one second portion (132, 133) having a second angle of application (B) in the tight-fitting joint, and that respective female contacts (16, 17), into which contact pins (23, 24) for making contact with the high voltages extend, are incorporated in each second cone portion (132, 133). The first angle of application (A) is preferably greater than the second angle of application (B) in this case, thus causing good insulation against high voltages to be ensured by a high applied pressure from the plug.

8 Claims, 1 Drawing Sheet

U.S. PATENT DOCUMENTS

Figure 1:
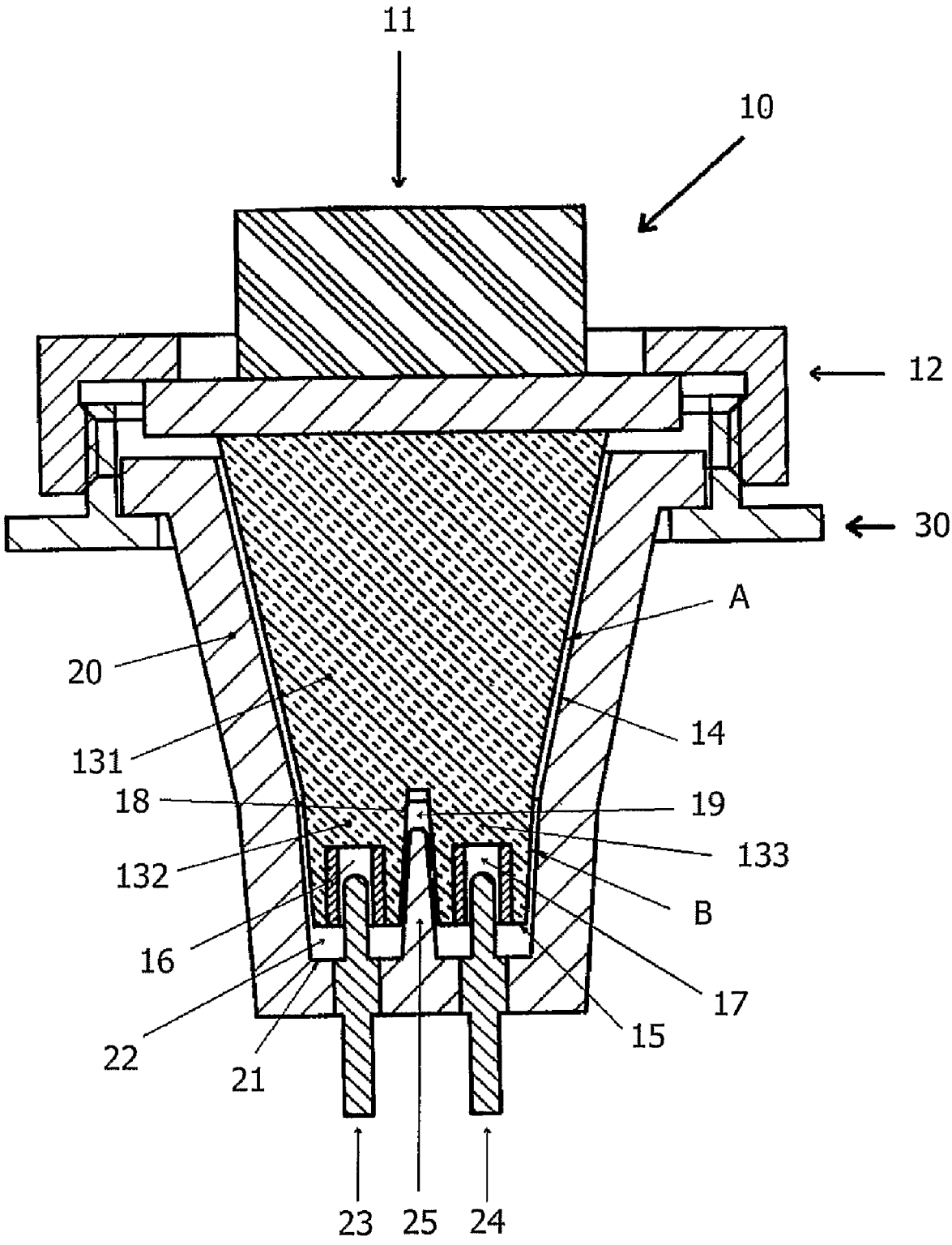

| | | | | |
|---|---|---|---|---|
| 7,204,705 | B2 * | 4/2007 | Negle et al. | 439/181 |
| 7,445,517 | B2 * | 11/2008 | Hansen et al. | 439/676 |
| 2002/0068473 | A1 | 6/2002 | Jedlitschka et al. | |

FOREIGN PATENT DOCUMENTS

| | | | |
|---|---|---|---|
| FR | 2755797 | A | 5/1998 |
| WO | WO 2004/062044 | A1 | 7/2004 |

* cited by examiner

HIGH-VOLTAGE RUBBER CONE PLUG-IN CONNECTOR

The invention relates to a high-voltage connector, having a plug with a rubber cone for insertion into a socket or mating connector-half. A connector of this kind is also referred to as a rubber-cone plug system and is used in particular for connecting X-ray generators to high-voltage generators that operate with relatively high grid and/or focusing voltages.

In essence, a distinction is made between three different high-voltage connectors or high-voltage connector systems. These are firstly what are known as O3 and O4 systems in which an insulating oil, an insulating grease or a soft insulating disk, such as a silicone disk, is used between the connecting pins to insulate the high grid voltage.

However, a disadvantage of these systems lies in the fact that they can only be used for nominal grid voltages between the pins of approximately 4 kV, because the pins are, situated relatively close to one another and sparkovers may thus occur at higher pin voltages.

Also known are rubber-cone plug systems that are relatively simple in construction and can be produced to relatively small dimensions. In these systems, insulation against high voltages is obtained by increasing the length of the leakage path by means of a slot structure. For this purpose, a straight ridge on the mating connector-half is for example introduced into a straight slot at the tip of the rubber cone of the plug.

However, a major problem with these systems lies in controlling the temperature cycles and the expansion related to them, particularly of the rubber cone, in such a way that the insulation of the plug system against high voltage is not impaired by them. Also, because there is air along the leakage paths, there is a risk of discharges occurring along the surface at fairly high voltages and of a surface flashover taking place through the insulation provided by the air.

Finally, the systems known as flat connector systems have essentially the same disadvantages as the O4 systems. For these flat connectors to be suitable for high pin voltages, the pins have to be situated relatively far apart, which means that the dimensions of the connectors become relatively large and call for a correspondingly large space to be provided in the X-ray generator and high-voltage generator for the connectors to be installed in.

A general object of the invention is therefore to provide a high-voltage connector of the kind specified in the opening paragraph whose insulation against high voltages will be reliably maintained over a long period.

The intention of the invention is, in particular, to provide a high-voltage connector of the kind specified in the opening paragraph that can be produced even for relatively high grid voltages and/or focusing voltages in a range of, for example, up to approximately 30 kV, which voltages are superimposed on the high voltage proper of approximately 160 kV.

Finally, the intention with the invention is also to provide a high-voltage connector of the kind specified in the opening paragraph that can be constructed relatively simply and manufactured inexpensively.

This object is achieved in accordance with claim 1 by a high-voltage connector, having a plug with a rubber cone for insertion in a mating connector-half, the rubber cone having a first portion and at least two second portions having respective female contacts for making contact with respective contact pins on the mating connector-half, the second cone portions being separated from one another by a slotted recess in the rubber cone into which a ridge arranged on the mating connector-half extends to form a tight-fitting joint insulated against high voltage.

A particular advantage of this solution is that, for example, single-pole high voltages for a plurality of relatively high grid or focusing voltages can be carried by a plug-in connector without this detracting from the insulation of the connector against high voltages.

A further advantage of this solution lies in the fact that the insulation against high voltage is not reduced even by a large number of temperature cycles that involve considerable thermal fluctuations due to the varying operating temperatures of the pieces of equipment that are connected.

Finally, the high-voltage connector can also be produced in a relatively small form.

The dependent claims relate to advantageous embodiments of the invention.

These and other aspects of the invention are apparent from and will be elucidated with reference to the embodiments described hereinafter.

In the drawing:

FIG. 1 is a diagrammatic cross-section through a high-voltage connector according to the invention.

The invention will be described below by reference to an embodiment of high-voltage connector which is able to carry, or in other words insulates, a single-pole high voltage of up to approximately 200 kV and, on this potential, two grid or focusing voltages of up to approximately 30 kV.

The high-voltage connector is composed essentially of a plug 10 and a socket or mating connector-half 20. Connected to the plug 10 is the end of a high-voltage cable 11, while the socket 20 is installed in the usual way in a housing 30 of a high-voltage device such as, for example, a high-voltage generator or an X-ray generator.

Having been inserted in the socket 20, the plug 10 is locked to the socket 20 by a fastening means 12 such as, for example, a bayonet lock or screwed closure.

An essential part of the plug 10 is the rubber cone 131; 132, 133, which is composed of a first cone portion 131 and at least two second cone portions 132, 133 at the tip of the first cone portion 131.

Between the rubber cone 131; 132, 133 and the socket 20 is situated what is known as a tight-fitting joint 14, for the insulation of which against high voltages it is most important for there to be a high applied force between the rubber cone 131; 132, 133 and the socket 20.

Between the tip 15 of the cone at the bottom end of the plug 10 (i.e. the bottom end of the section cone portions 132, 133) and the floor 21 of the socket 20 is a first expansion space 22 which is at least sufficiently deep to provide enough room for axial thermal expansion of the rubber cone 131; 132, 133 when heated to any realistic operating temperature by the components that are connected.

In the simplest case, the first expansion space 22 is filled with air. It may however equally well contain some other gas such as, for example, nitrogen or may, if required, be under vacuum. The first expansion space 22 may also be filled with a material that is able to be compressed by the rubber cone as it expands thermally. A material of this kind is for example a suitable soft rubber or silicone containing gas inclusions.

Incorporated in the tip 15 of the cone are two female contacts 16, 17 to act as contacts for the high voltage and, between them, a slot 18. The walls of the slot 18 are preferably parallel to one another or extend towards one another in a substantially conical shape. The width of the slot (in the direction perpendicular to the plane of the drawing in FIG. 1) covers the full diameter of the rubber cone. For each bore 16; 17, this slot forms a boundary of an individual second cone portion 132, 133.

When the plug 10 is inserted in the mating connector-half 20, there extend into the female contacts 16, 17 respective corresponding contact pins 23, 24 which extend through the mating connector-half 20 under insulated connections, and there extends into the slot 18 a corresponding ridge 25 formed on the mating connector-half 20.

This ridge 25 is of substantially the same width as the slot 18, i.e. it extends in the slot 18 across the full diameter of the rubber cone.

As shown in FIG. 1, the ridge 25 tapers in this case in its lengthwise direction in a substantially conical shape. What is achieved in this way is that when the plug 10 is inserted in the mating connector-half 20, a correspondingly high applied pressure arises between the ridge 25 and the walls of the slot 18, and the second cone portions 132, 133 are thus also each enclosed by a tight-fitting joint. High insulation against high voltages is achieved in this way between the contacts pins 23, 24 and between the female contacts 16, 17.

At the same time, the ridge 25 also helps to increase the applied pressure between the second cone portions 132, 133 and the regions of the inner wall of the mating connector-half 20 that bear against them.

In place of this construction, looking from below in an end-on view of what is shown in FIG. 1, there may equally well be incorporated in the tip of the cone four first female contacts, arranged substantially at the corners of a square, for corresponding contact pins, together with a slot, which is cruciform in this case, between the female contacts, to produce four second cone portions each with a female contact.

In the embodiment shown in FIG. 1, the first contact pin 23 for example may be used as a contact for the high voltage and the second contact pin 24 as a contact for the grid or focusing voltage superimposed on the high voltage. To ensure that safe and secure contact is made, the female contacts 16, 17 are provided with known contacting faces or are clad in a known manner. The conductors connected to the female contacts, which run through the rubber cone 131, 132; 131, 133, are not shown.

The depth of the slot 18 in the rubber cone and the length of the ridge 25 are adjusted to one another in such a way that a second expansion space 19 is left, in a similar way to what happens between the tip 15 of the cone and the floor 21 of the mating connector-half 20. With regard to the sizing and operation of this second expansion space 19, the same applies as was explained above with regard to the first expansion space 22.

As is also clear from FIG. 1, the first angle A to the vertical at which the first cone portion 131 is applied to the inner wall of the mating connector-half 20 is larger (and is for example approximately 6°) than the second angle B to the vertical (which is for example approximately 2°) at which the second cone portions 132, 133 are applied to the said inner wall. When the plug 10 is pressed into the mating connector-half 20, this stops the tight-fitting joint 14 at the second cone portions 132, 133 from reducing the applied force at the tight-fitting joint 14 at the first cone portion 131, which insulates the high voltage, and stops a risk of high-voltage flashovers from arising in this way.

It would however also be possible for both the angles of application A, B to be made of the same size.

The angle of application to the vertical between the ridge 25 and the side-walls of the slot 18 substantially corresponds to the second angle of application B between the second cone portions 132, 133 and the inner wall of the mating connector-half 20, or is smaller than it.

In this way, the first cone portion 131 serves to insulate the high voltage (high-voltage cone or main cone), whereas the second cone portions 132, 133 perform the function of insulating the grid and/or focusing voltages (grid cones).

What is achieved with the design according to the invention is, at the same time, both good insulation against high voltages for the tight-fitting joint 14 between the first cone portion 131 and the inner wall of the mating connector-half 20, and also good insulation against high voltages for the tight-fitting joints between the second cone portions 132, 133 (and hence between the female contacts 16, 17 themselves and between the contact or connecting pins 23, 24 themselves).

The high-voltage plug-in connector according to the invention opens up the possibility of using, in high-grade X-ray systems, single-pole high-powered X-ray tubes operating at a high voltage level (such as 160 kV single pole for example) and having a plurality of high grid or focusing voltages (e.g. twice 10 kV), for which tubes is required a rubber-cone plug-in connector having a plurality of grid conductors or heating conductors that is more stable at temperature and better insulated against high voltages.

The invention claimed is:

1. A high-voltage connector, having a plug with a rubber cone for insertion in a mating connector-half having a floor, the rubber cone having a first cone portion and at least two second cone portions having respective female contacts for making contact with respective contact pins on the mating connector-half, the second cone portions being separated from one another by a slotted recess in the rubber cone into which a ridge arranged on the mating connector-half extends to form a tight-fitting joint insulated against high voltage, and a tip of the bottom end of the second cone portions on the side by the floor, so that when the rubber cone is inserted in the mating connector-half, a first expansion space into which the second cone portions can expand is present between the tip of the bottom end of the second cone portions and the floor of the mating connector-half, wherein the slotted recess and the ridge are adjusted to one another in such a way that, when the rubber cone is inserted in the mating connector-half, a second expansion space, into which the rubber cone portions can expand thermally, is present at the tip of the ridge.

2. A high-voltage connector as claimed in claim 1, in which there is a tight-fitting joint insulated against high voltage between the rubber cone and the mating connector-half and wherein a first angle of application (A) of the tight-fitting joint between the first cone portion and the mating connector-half is equal to or greater than a second angle of application (B) of the tight-fitting joint between the second cone portion and the mating connector-half.

3. A high-voltage connector as claimed in claim 1, in which, when the rubber cone is inserted in the mating connector-half, the ridge extends into the recess in a taper in a conical shape.

4. A high-voltage connector as claimed in claim 2, in which a (third) angle of application between the slotted recess and the ridge is equal to or less than the first angle of application (A) between the first cone portion and the inner wall of the mating connector-half.

5. A high-voltage connector as claimed in claim 1, in which the expansion spaces are filled with a medium that can be compressed by thermal expansion of the rubber cone.

6. A high-voltage connector as claimed in claim 5, in which the medium is a gas and/or a silicone material having gas inclusions.

7. A high-voltage cable, in particular for connecting an X-ray generator to a high-voltage generator, having at least one high-voltage connector as claimed in claim 1.

8. An X-ray system having an X-ray generator and a high-voltage connector as claimed in claim 1.

* * * * *